United States Patent [19]

Puccio

[11] 4,378,176

[45] Mar. 29, 1983

[54] EXPANSION JOINT SNOWPLOW DEFLECTOR

[75] Inventor: Guy S. Puccio, Snyder, N.Y.

[73] Assignee: Acme Highway Products Corporation, Amherst, N.Y.

[21] Appl. No.: 174,651

[22] Filed: Aug. 1, 1980

[51] Int. Cl.[3] ..... E01C 11/04

[52] U.S. Cl. ..... 404/69; 404/15; 52/396; 49/475

[58] Field of Search ..... 404/68, 69, 15, 16, 404/9; 52/396; 49/486, 475

[56] References Cited

U.S. PATENT DOCUMENTS

| | | | |
|---|---|---|---|
| 1,702,496 | 2/1929 | Cornell, Jr. | 404/15 |
| 2,229,179 | 1/1941 | Langdon | 404/16 |
| 3,292,506 | 12/1966 | Kone | 404/11 |
| 3,394,639 | 7/1968 | Viehmann | 404/47 |
| 3,435,574 | 4/1969 | Hallock | 404/69 |
| 3,659,390 | 5/1972 | Balzer et al. | 404/69 |
| 3,677,145 | 7/1972 | Wattiez | 404/58 |
| 3,779,660 | 12/1973 | McGeary et al. | 404/69 |
| 3,854,835 | 12/1974 | Stog | 404/68 |
| 3,880,539 | 4/1975 | Brown | 404/48 |
| 4,007,994 | 2/1977 | Brown | 404/69 |
| 4,140,419 | 2/1979 | Puccio | 52/396 |
| 4,147,447 | 4/1979 | Heenan et al. | 404/16 |
| 4,155,666 | 5/1979 | Flanagan | 404/16 |
| 4,195,945 | 4/1980 | Heenan | 404/16 |

FOREIGN PATENT DOCUMENTS

| | | | |
|---|---|---|---|
| 70113 | 3/1946 | Norway | 404/15 |

*Primary Examiner*—Nile C. Byers, Jr.

*Attorney, Agent, or Firm*—Christel, Bean & Linihan

[57] ABSTRACT

A deflector comprising a stem portion and a deflecting body portion for protecting a roadway expansion joint. The stem portion anchors the deflector in an operating position in which the body portion deflects snow plow blades and the like upwardly away from the expansion joint.

7 Claims, 4 Drawing Figures

Fig. 1.
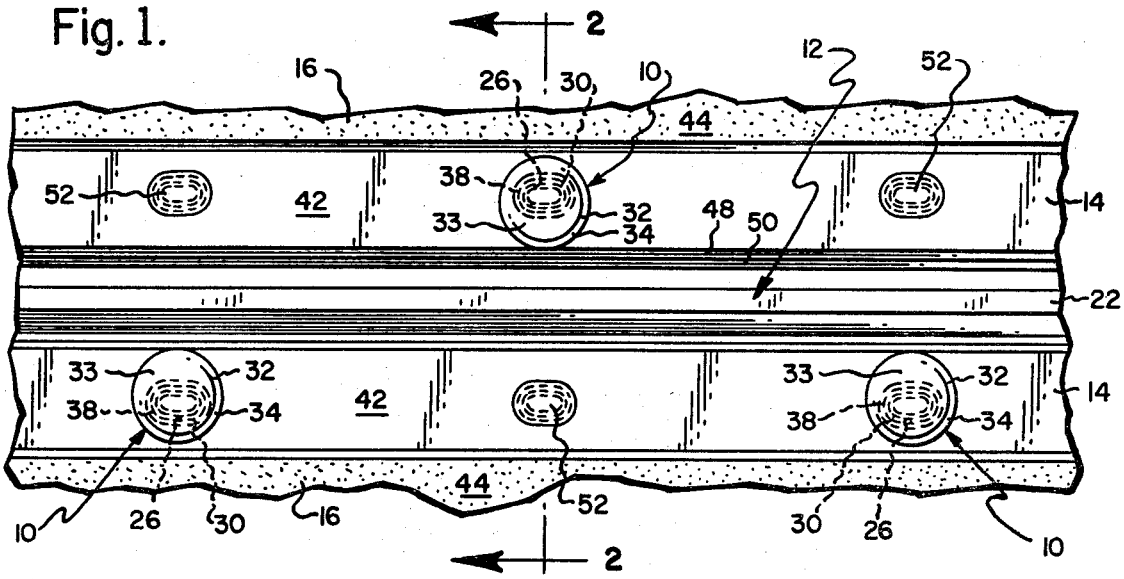
Fig. 2.
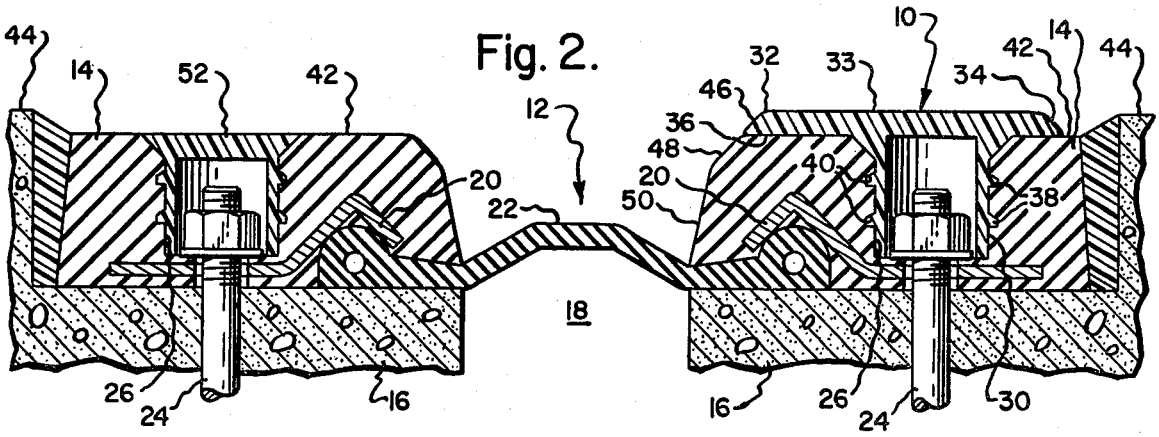
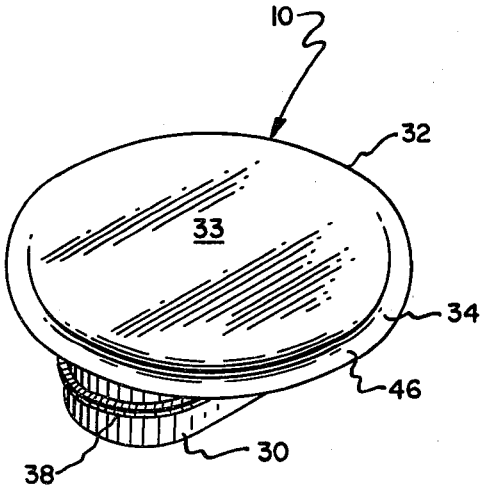
Fig. 3.
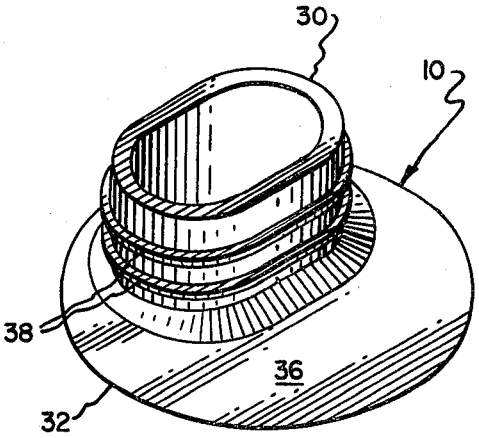
Fig. 4.

EXPANSION JOINT SNOWPLOW DEFLECTOR

BACKGROUND OF THE INVENTION

This invention relates to a deflector for protecting a roadway expansion joint against scarring and other damage by snowplow blades and the like.

Expansion joints are exposed not only to weathering and deleterious chemicals, but also to damaging contact by snowplow blades and the like. This can be destructive, particularly of expansion joint sections made of resiliently yieldable materials.

It is desirable to protect expansion joints from such damage and it is advantageous to provide this protection simply, utilizing existing features of existing expansion joints.

SUMMARY OF THE INVENTION

Accordingly, a primary object of the present invention is to provide a relatively inexpensive protective member which can be applied quickly and easily to existing expansion joint constructions.

Another object of the present invention is to provide a protective member which can be secured in an anchor bolt receiving aperture and is operable to deflect and support snowplow blades and the like above the joint surfaces to be protected.

In summary, the present invention provides a deflector for protecting a roadway expansion joint. In one aspect thereof, the deflector is characterized by the provision of an anchoring stem portion and a deflecting body portion, the stem portion fitting within an anchor bolt aperture with the body portion seated on the upper surface of the joint. Snowplow blades and the like contacting the body portion of the deflector are deflected over the joint and supported by the deflector.

The foregoing and other objects, advantages and characterizing features of the present invention will become clearly apparent from the ensuing detailed description of an illustrative embodiment thereof, together with the accompanying drawing wherein like reference numerals denote like parts throughout the various views.

BRIEF DESCRIPTION OF THE DRAWING FIGURES

FIG. 1 is a fragmentary top plan view of a roadway expansion joint equipped with deflectors of the present invention;

FIG. 2 is a vertical sectional view thereof, taken about on line 2—2 of FIG. 1;

FIG. 3 is a perspective view highlighting the top surface of the deflector of FIGS. 1 and 2; and FIG. 4 is a perspective view showing the underside of the deflector shown in FIG. 3.

DETAILED DESCRIPTION OF THE ILLUSTRATED EMBODIMENT

A deflector of this invention, generally designated 10, is shown in combination with an expansion joint 12 of the type disclosed in U.S. Pat. No. 4,140,419, hereby incorporated by reference. Joint 12 comprises a pair of elongated edge members 14 seated on and secured to roadway sections 16 separated by a gap 18. Mounting plates 20 are embedded in edge members 14, and engage and secure in position a sealing strip 22 which spans gap 18 when edge members 14 are fastened to roadway sections 16 by anchor bolts 24.

Apertures 26 are provided in edge members 14 to receive anchor bolts 24, and open through the upper, top surfaces 42 of members 14.

Deflector 10 preferably is composed of a relatively rigid, light weight, durable, elastomeric resinous material capable of withstanding temperature extremes, sunlight, weathering, oxidation, and deleterious chemicals to which it will be subject during use in roadways. Deflector 10 also is of a material capable of withstanding and deflecting the impact of snowplow blades, street sweepers and other devices without damaging such devices, and is capable of supporting vehicles of all types and of providing protection for various surfaces and will withstand such impact and other loading over a long, useful life.

The deflector 10 is a molded, unitary, one piece construction, of any desired size, and comprises a stem portion 30 and a deflecting body portion 32. Deflecting body portion 32 is a solid disc of circular shape in plan view, having a generally arcuately beveled peripheral edge portion. It is comprised of generally flat, parallel top and bottom surfaces joined by a convex edge surface 34 which defines the periphery of deflecting body portion 32. While edge surface 34 is shown curving upwardly and inwardly from bottom surface 36 to top surface 33 it can be beveled, in either case providing an inclined edge to facilitate snowplow blade movement over deflector 10. Stem portion 30 is hollow, elongated, and generally oblong in section, being defined by parallel side walls joined by curved end walls of generally uniform wall thickness, and having parallel rib or ridge formations 38 around the exterior surface thereof. The exterior surface of stem portion 30 is flared at its top end, blending into the bottom surface 36 of deflecting body portion 32.

As shown in FIG. 2 stem portion 30 of deflector 10 is received in an aperture 26 in an edge member 14. Surface formations 38 are received in corresponding cavities 40 provided in the aperture wall whereby deflector 10 is held against movement out of the aperture 26. The depth of aperture 26 is at least equivalent to the length of stem portion 30, and the surface formations 38 and the corresponding cavities 40 are so positioned and arranged that the bottom surface 36 of deflecting body portion 32 uniformly abuts and is contiguous with the upper surface 42, of edge member 14, seating firmly thereon. The upper surface 42 of side member 14 is generally parallel to upper surface 44 of roadway section 16, and is disposed below that surface by approximately the thickness of deflecting body portion 32.

Stem 30 is positioned off center in relation to deflecting body portion 32, and the latter is sized so that when stem 30 is positioned within aperture 26 the leading edge surface 46 of deflecting body portion 32 forms a continuation of the tapered upper portion 48 of the gap face 50 of edge member 14. With this arrangement, deflectors 10 contact snowplow blades and the like and deflect them upwardly, over and above the exposed, vulnerable surfaces 48 and 42 of edge members 14, protecting the latter against scarring and damage. The oblong configuration of stem portion 30 conforms to the cross sectional configuration of aperture 26 and prevents rotation of deflector 10 after it has been mounted in edge member 14, thereby maintaining the desired alinement of leading edge surface 46 and gap edge surface 48.

FIG. 1 illustrates deflectors 10 installed in an alternating configuration in selectively spaced apertures 26 provided in opposing edge members 14. Such a configuration frequently is sufficient to provide the desired protection for the roadway expansion joint, and the remaining apertures 26 can be closed by simple plugs 52 which are flush with surface 42 and protect the underlying anchor bolt assembly from external road and weather conditions. Where circumstances require, deflectors 10 can be positioned in each and every aperture 26 in edge members 14.

It is apparent from the foregoing that the present invention accomplishes its intended objects. While a preferred embodiment of the invention has been described and illustrated in detail, it will be understood that such description and illustration is by way of example only and such modification and changes as may suggest themselves to those skilled in the art are intended to fall within the scope of the present invention as defined by the appended claims. It will be appreciated that the snowplow deflector of this invention also will find utility in expansion joints other than the one selected for illustration herein. If the expansion joint edge member is made of metal, the deflectors will absorb sound as well as impact forces.

What is claimed is:

1. A deflector for protecting a roadway expansion joint from snowplow blades and the like, the joint having edge members positioned below the roadway surface and being of the type having a surface to be protected and having an aperture therein, said deflector comprising:

a. an anchoring stem portion of non-circular cross section held against rotation in the expansion joint aperture, said stem portion including outwardly extending circumferential ridge means engageable with correspondingly shaped grooves in said aperture; and b. a deflecting body portion joined to said stem portion at one end thereof for projection above the expansion joint surface to be protected, said body portion including a substantially planar top surface spaced from the top of said stem portion to deflect a snowplow blade away from the expansion joint surface.

2. A deflector as set forth in claim 1 wherein said circumferential ridge means comprises at least two spaced, unconnected, outwardly extending ribs for securing said deflector in an expansion joint aperture.

3. A deflector as set forth in claim 1 wherein said body portion has generally flat, parallel top and bottom surfaces joined by a peripheral edge portion extending upwardly and inwardly from said bottom surface.

4. A deflector in combination with a roadway expansion joint for protecting the joint from snowplow blades and the like, the joint being of the type having a surface to be protected and having an aperture therein, said combination comprising:

a. a pair of elongated edge members having an upper surface and apertures therethrough receiving anchor bolts for securing said edge members to roadway sections on opposite sides of a gap, said edge members positioned below the roadway surface;

b. a deflector having an anchoring stem portion positioned in one of said expansion joint apertures, said stem portion including outwardly extending circumferential ridge means engageable with correspondingly shaped grooves in said aperture; and c. said deflector including a deflecting body portion joined to said stem portion at one end thereof for projecting above the expansion joint surface to be protected, said body portion including a bottom surface, a substantially planar top surface spaced from said bottom surface and in overlying relationship to said joint surface to deflect a snowplow blade away from said joint surface and further including a peripheral edge portion joining said top and bottom surfaces and being arranged so that when said anchoring stem portion is positioned in said expansion joint aperture said body portion bottom surface is seated on said upper surface of the associated edge member of said joint and said bottom surface is positioned below the roadway surface.

5. A deflector and expansion joint as set forth in claim 4, wherein said stem portion and said aperture each have a non-circular cross section to prevent relative rotation.

6. A deflector and expansion joint as set forth in claim 4, wherein said body portion extends substantially completely across said upper surface of said edge member in a direction perpendicular to the longitudinal axis thereof.

7. A deflector and expansion joint as set forth in claim 4, wherein said edge members are of resiliently yieldable material, and said deflectors are of synthetic resinous material, said edge members having a plurality of anchor bolt receiving apertures spaced apart therealong in a direction generally parallel to the gap, and a plurality of deflectors anchored in selected ones, but not all, of said apertures.

* * * * *